US008920214B2

(12) United States Patent
Sung

(10) Patent No.: US 8,920,214 B2
(45) Date of Patent: Dec. 30, 2014

(54) DUAL DRESSING SYSTEM FOR CMP PADS AND ASSOCIATED METHODS

(76) Inventor: Chien-Min Sung, Tansui (TW)

( * ) Notice: Subject to any disclaimer, the term of this patent is extended or adjusted under 35 U.S.C. 154(b) by 257 days.

(21) Appl. No.: 13/531,409

(22) Filed: Jun. 22, 2012

(65) Prior Publication Data

US 2013/0165023 A1 Jun. 27, 2013

Related U.S. Application Data

(60) Provisional application No. 61/507,063, filed on Jul. 12, 2011, provisional application No. 61/522,803, filed on Aug. 12, 2011.

(51) Int. Cl.
*B24B 53/017* (2012.01)

(52) U.S. Cl.
CPC ..... *B24B 53/017* (2013.01)
USPC ..... 451/56; 451/72; 451/443

(58) Field of Classification Search
CPC ..... B24B 53/017; B24B 53/12; B24B 53/14
USPC ..... 451/56, 72, 443
See application file for complete search history.

(56) References Cited

U.S. PATENT DOCUMENTS 6,036,583 A * 3/2000 Perlov et al. ..... 451/56
6,241,588 B1 * 6/2001 Brown et al. ..... 451/56
6,273,798 B1 * 8/2001 Berman ..... 451/72
6,390,902 B1 * 5/2002 Chang et al. ..... 451/285
6,935,938 B1 * 8/2005 Gotkis et al. ..... 451/443
6,976,907 B2 * 12/2005 Golzarian et al. ..... 451/56
7,097,545 B2 * 8/2006 Lee et al. ..... 451/72
7,207,864 B2 * 4/2007 Kamimura et al. ..... 451/5
7,285,039 B1 * 10/2007 Sung ..... 451/56
7,367,872 B2 * 5/2008 Donohue ..... 451/72
7,452,264 B2 * 11/2008 Mavliev et al. ..... 451/56
7,559,824 B2 * 7/2009 Park et al. ..... 451/11
7,749,048 B2 * 7/2010 Wang et al. ..... 451/5
7,846,007 B2 * 12/2010 Stinson et al. ..... 451/5
2004/0102045 A1 * 5/2004 Chopra et al. ..... 438/689
2006/0046619 A1 * 3/2006 Lin et al. ..... 451/8
2006/0079160 A1 * 4/2006 Balagani et al. ..... 451/285
2008/0242199 A1 * 10/2008 Saito ..... 451/37
2010/0291840 A1 * 11/2010 Huang et al. ..... 451/56
2012/0270477 A1 * 10/2012 Nangoy et al. ..... 451/56
2013/0165023 A1 * 6/2013 Sung ..... 451/56

* cited by examiner

*Primary Examiner* — George Nguyen
(74) *Attorney, Agent, or Firm* — Thorpe North & Western LLP

(57) ABSTRACT

Dual dressing systems for conditioning CMP pads, including associated methods, are provided. In one aspect, for example, a method of dressing a CMP pad can include applying a deglazing dresser to a working surface of a CMP pad, deglazing the working surface of the CMP pad with the deglazing dresser, applying an asperity-forming dresser to the working surface of the CMP pad, and forming asperities in the working surface of the CMP pad with the asperity-forming dresser.

16 Claims, 2 Drawing Sheets

DUAL DRESSING SYSTEM FOR CMP PADS AND ASSOCIATED METHODS

PRIORITY DATA

This application claims the benefit of U.S. Provisional Patent Application Ser. Nos. 61/507,063 and 61/522,803, filed on Jul. 12, 2011 and Aug. 12, 2011 respectively, which are each incorporated herein by reference.

BACKGROUND OF THE INVENTION

The semiconductor industry currently spends in excess of one billion U.S. dollars each year manufacturing silicon wafers that must exhibit very flat and smooth surfaces. Known techniques to manufacture smooth and even-surfaced silicon wafers are plentiful. The most common of these involves the process known as Chemical Mechanical Polishing (CMP) which includes the use of a polishing pad in combination with an abrasive slurry. Of central importance in all CMP processes is the attainment of high performance levels in aspects such as uniformity of polished wafer, smoothness of the IC circuitry, removal rate for productivity, longevity of consumables for CMP economics, etc.

SUMMARY OF THE INVENTION

The present disclosure provides dual dressing systems for conditioning CMP pads, including associated methods. In one aspect, for example, a method of dressing a CMP pad can include applying a deglazing dresser to a working surface of a CMP pad, deglazing the working surface of the CMP pad with the deglazing dresser, applying an asperity-forming dresser to the working surface of the CMP pad, and forming asperities in the working surface of the CMP pad with the asperity-forming dresser. In one aspect, the working surface of the CMP pad is substantially completely deglazed prior to forming the asperities. In another aspect, substantially the entire working surface of the CMP pad is substantially completely deglazed prior to forming the asperities. In yet another aspect, deglazing the working surface and forming asperities in the working surface occur simultaneously at distinct and separate locations on the working surface until all, or substantially all, of the working surface has been conditioned.

Various deglazing techniques are contemplated, and any such technique is considered to be within the present scope. In one non-limiting example, deglazing the working surface of the CMP pad includes shaving off a thickness of the working surface of the CMP pad. Thus, the portion of the working surface having the hardened or glazed layer is shaved off. This can be accomplished by a variety of methods, such as, for example, shaving off the thickness of the working surface with a plurality of blade elements coupled to the deglazing dresser.

Various asperity-forming techniques are contemplated, and any such technique is considered to be within the present scope. In one non-limiting aspect, asperities can be formed on the working surface of the CMP pad with a plurality of superabrasive particles coupled to the asperity-forming dresser. The plurality of superabrasive particles can be in any configuration/orientation capable of forming asperities in the working surface. In one aspect, however, the superabrasive particles are arranged in a monolayer of superabrasive particles where the difference in protrusion distance between the highest protruding tip and the next highest protruding tip of the monolayer of superabrasive particles is less than or equal to about 20 microns and the difference in protrusion distance between the highest 1% of the protruding tips of the monolayer of superabrasive particles are within about 80 microns or less.

In another aspect, the method can also include applying a cleansing spray to the working surface during deglazing. In one aspect, the cleansing spray is a water jet. Additionally, in some aspects the method can include applying a suction to the working surface to remove debris released from the CMP pad during deglazing.

In yet another aspect, the method can include vibrating at least one of, or both of, the deglazing dresser and the CMP pad relative to one another during deglazing or the asperity-forming dresser and the CMP pad relative to one another during formation of the asperities. In one specific aspect, the vibrating is ultrasonic vibrating.

The present disclosure additionally includes systems for dressing a CMP pad. In one aspect such a system can include a deglazing dresser positioned to engage a CMP pad and an asperity-forming dresser positioned to engage the CMP pad, where the deglazing dresser and the asperity-forming dresser are each capable of independently dressing the CMP pad. In one aspect, the system can further include a platen for holding and rotating the CMP pad, where the platen is positioned to engage the deglazing dresser and the asperity-forming dresser.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

Figure 1:
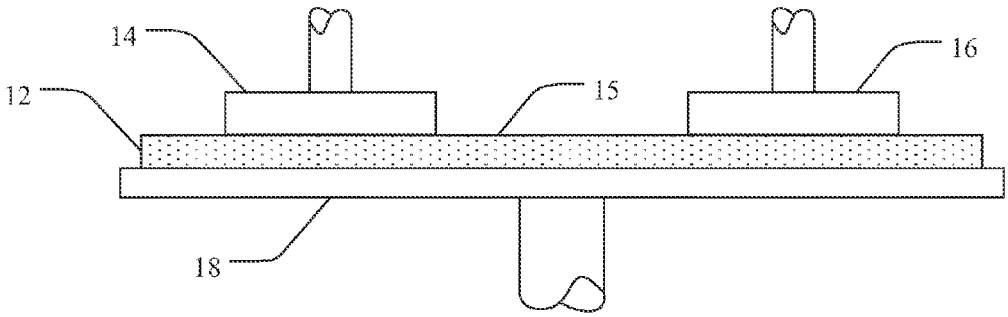
FIG. 1 is a schematic side view of a dressing system in accordance with an embodiment of the present invention.

It will be understood that the above figures are merely for illustrative purposes in furthering an understanding of the invention. Further, the figures are not drawn to scale, thus dimensions, particle sizes, and other aspects may, and generally are, exaggerated to make illustrations thereof clearer. Therefore, departure can be made from the specific dimensions and aspects shown in the figures in order to produce the heat spreaders of the present invention.

DETAILED DESCRIPTION

Before the present invention is disclosed and described, it is to be understood that this invention is not limited to the particular structures, method steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms “a,” “an” and, “the” include plural referents unless the context clearly dictates otherwise. Thus, for example, reference to “a diamond particle" includes one or more of such particles and reference to "the layer" includes reference to one or more of such layers.

DEFINITIONS

In describing and claiming the present invention, the following terminology will be used in accordance with the definitions set forth below.

As used herein, the terms "conditioner" and "dresser" can be used interchangeably, and refer to a tool used to condition or dress a pad, such as a CMP pad.

As used herein, "superabrasive" may be used to refer to any crystalline, or polycrystalline material, or mixture of such materials which has a Mohr's hardness of about 8 or greater. In some aspects, the Mohr's hardness may be about 9.5 or greater. Such materials include but are not limited to diamond, polycrystalline diamond (PCD), cubic boron nitride (cBN), polycrystalline cubic boron nitride (PcBN), corundum and sapphire, as well as other superabrasive materials known to those skilled in the art. Superabrasive materials may be incorporated into the present invention in a variety of forms including particles, grits, films, layers, pieces, segments, etc. In some cases, the superabrasive materials of the present invention are in the form of polycrystalline superabrasive materials, such as PCD and PcBN materials.

As used herein, "dressing segment" refers to a dressing or conditioning element of a CMP pad dresser. Dressing segments are utilized in the present invention to carry superabrasive particles, cutting blades, or other dressing elements. In one aspect, superabrasive particles are introduced into a CMP pad dresser by the incorporation of multiple dressing segments. It should be noted that a variety of techniques of attaching the dressing segments to the substrates, and a variety of techniques of attaching the superabrasive particles to the dressing segments, are discussed herein. It is to be understood that all of these various attachment mechanisms can be used interchangeably herein: that is, if a method of attaching a dressing segment to a substrate is discussed herein, the method of attachment discussed can also be used to attach superabrasive particles to a dressing segment. For any particular CMP pad dresser being discussed, however, it is understood that attachment methods of the superabrasive particles to the dressing segments can differ from, or can be the same as, the method used to attach the dressing segments to the pad conditioner substrate.

As used herein, "organic material" refers to a semisolid or solid complex or mix of organic compounds. "Organic material layer" and "organic matrix" may be used interchangeably, and refer to a layer or mass of a semisolid or solid complex or mix of organic compounds, including resins, polymers, gums, etc. The organic material can be a polymer or copolymer formed from the polymerization of one or more monomers. In some cases, such organic material can be adhesive.

As used herein, the process of "brazing" is intended to refer to the creation of chemical bonds between the carbon atoms of the superabrasive particles/materials and the braze material. Further, "chemical bond" means a covalent bond, such as a carbide or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, for example, brazing of a superabrasive segment to a tool body does not necessarily require the presence of a carbide former.

As used herein, "particle" is as used herein in connection with diamond particles, and refers to a particulate form of diamond. Such particles may take a variety of shapes, including round, oblong, square, euhedral, etc., can be either single crystal or polycrystalline, and can have a number of mesh sizes. As is known in the art, "mesh" refers to the number of holes per unit area as in the case of U.S. meshes. All mesh sizes referred to herein are U.S. mesh unless otherwise indicated. Further, mesh sizes are generally understood to indicate an average mesh size of a given collection of particles since each particle within a particular "mesh size" may actually vary over a small distribution of sizes.

As used herein, "sintering" refers to the joining of two or more individual particles to form a continuous solid mass. The process of sintering involves the consolidation of particles to at least partially eliminate voids between particles.

The term "metallic" refers to both metals and metalloids. Metals include those compounds typically considered metals found within the transition metals, alkali and alkali earth metals. Examples of metals are Ag, Au, Cu, Al, and Fe. Metalloids include specifically Si, B, Ge, Sb, As, and Te. Metallic materials also include alloys or mixtures that include metallic materials. Such alloys or mixtures may further include additional additives. In the present invention, carbide formers and carbon wetting agents may be included as alloys or mixtures, but are not anticipated to be the only metallic component. Examples of such carbide formers are Sc, Y, Ti, Zr, Hf, V, Nb, Cr, Mo, Mn, Ta, W, and Tc. Examples of carbon wetting agents are Co, Ni, Mn, and Cr.

As used herein, "infiltrating" refers to a situation where a material is heated to its melting point and then flows as a liquid through the interstitial voids between particles.

As used herein, "deglazing" refers to the removal of the glazed portion of the working surface of a CMP pad.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The Invention

The present disclosure provides dual dressing systems for conditioning CMP pads, including associated methods. As a CMP pad is used to polish a work piece, the performance of the CMP pad surface begins to degrade and harden by a process known as glazing. Glazing occurs, at least in part, due to a buildup of debris on the surface of the pad. In order to continue using the CMP pad, this glazed portion of the surface can be removed and fresh asperities can be cut, or otherwise formed, into the CMP pad surface. By performing deglazing and asperity-forming steps independently from one another, a high amount of control over the dressing conditions and the resulting CMP pad surface can be realized. Additionally, in one aspect, by confining the deglazing and asperity-forming operations to distinct dressers, smaller diameter dresser tools can be utilized, thus allowing greater control over the leveling of cutting elements in the dressers due to decreased warping of the dressers during manufacture when certain materials are used, such as brazing materials.

Traditional CMP pad dresser manufacturing methods, even many of those describing techniques for leveling superabrasive particle tips prior to fixation, generally contain significant variation in tip height across the surface of the dresser. Often, the superabrasive particles are affixed to the CMP pad dresser support in a manner that disrupts any leveling that has occurred. For example, fixation techniques that utilize high heat and/or pressure can cause warping of the dresser support as the dresser cools. Thus, unless steps are taken to avoid such warpage, superabrasive particles are not maintained in their leveled state following cooling of the dresser. This can be particularly problematic with brazing techniques. Thus, superabrasive tool bodies having smaller diameters have a lower incidence of warping as compared to superabrasive tool bodies having larger diameters, thus allowing greater control of superabrasive particle tips in the finished tool.

Leveled superabrasive particles can be particularly beneficial for dressing large area CMP pads used in polishing larger diameter wafers such as, for example, 18" wafers. The features created on such wafers can be extremely small, and as such can be inordinately difficult to polish using CMP pads having highly variable asperity configurations as are seen with CMP pads conditioned with traditional CMP pad dressers. Controlling the leveling of the tips of superabrasive particles in a dresser throughout the manufacturing process, for example, can allow much greater control over the physical characteristics of resulting asperities. Thus a CMP pad having uniformly formed asperities can more evenly polish the delicate features of larger diameter wafers.

Additionally, the size of the CMP pad is generally much greater for polishing larger size wafers. These large diameter CMP pads (e.g. a 40" diameter pad) can be difficult to dress to form uniform asperity sizes. As has been described, non-uniform asperities can create non-uniform polishing conditions, which can be particularly problematic for larger diameter wafers having nanometer size features (e.g. 22 nm). By dressing such large CMP pads using separate deglazing and asperity-forming dressers, the asperities formed thereon can be much more uniform as compared to traditional dressers. By deglazing the CMP pad in a separate action, the asperity-forming dresser can form asperities in a fresh, level surface, thus improving uniformity. Additionally, in some aspects, the asperity-forming dresser can utilize smaller superabrasive particles as compared to previous dressers. Such small superabrasive particles form smaller asperities, which allow for a gentler and more even polishing of wafers. For traditional dressing, the superabrasive particles of necessity have to both deglaze and form asperities. As it is difficult to deglaze a CMP pad with small superabrasive particles in such traditional dressers, larger particles are used to be able to cut through the glazed surface. In such a case, the asperities formed are of necessity larger due to the larger particle sizes, thus rendering the polishing of wafers having very small features difficult.

Accordingly, in one aspect a method of dressing a CMP pad can include applying a deglazing dresser to a working surface of a CMP pad, deglazing the working surface of the CMP pad with the deglazing dresser, applying an asperity-forming dresser to the working surface of the CMP pad, and forming asperities in the working surface of the CMP pad with the asperity-forming dresser. In another aspect, a system for dressing a CMP pad can include a deglazing dresser positioned to engage a CMP pad and an asperity-forming dresser positioned to engage the CMP pad, where the deglazing dresser and the asperity-forming dresser are each capable of independently dressing the CMP pad.

As is shown in FIG. 1, for example, a CMP pad 12 is shown being deglazed by a deglazing dresser 14. The deglazing dresser 14 can deglaze the working surface 15 of the CMP pad 12 by shaving off a thickness of the working surface, or in other words, shaving of the glazed portion of the CMP pad. In one aspect, the deglazing dresser 14 can include a plurality of blade elements coupled to the deglazing dresser, and such blade elements thus function to shave the working surface of the CMP pad as the deglazing dresser and/or the CMP pad is rotated. In another aspect, the deglazing dresser functions to deglaze the CMP pad, and does not form asperities therein.

Additionally, FIG. 1 shows an asperity-forming dresser 16 pressed against the CMP pad 12 to form asperities in the working surface 15. Asperities can be formed in the working surface by a variety of techniques, all of which are included in the present scope. In one aspect, for example, the asperities can be formed with a plurality of superabrasive particles coupled to the asperity-forming dresser 16. In this non-limiting case, the plurality of superabrasive particles cut asperities in the CMP pad 12 as the CMP pad and/or the asperity-forming dresser 16 is rotated. It should be noted that movements of the dressers are described as rotational for convenience sake, however it is contemplated that other dresser movements are considered to be within the present scope. Non-limiting examples of such movements can include elliptical movements, linear movements, random or pseudorandom movements, movements following a geometric or non-geometric path, vibrational movements, and the like.

FIG. 1 additionally shows a platen 18 upon which the CMP pad 12 is disposed during a polishing and/or conditioning procedure. The platen is positioned to allow the deglazing dresser and the asperity-forming dresser to engage the CMP pad held thereon. The CMP pad 12 is thus rotated by rotating the platen 18. The CMP pad 12 can be rotated during conditioning by the deglazing dresser 14 and/or the asperity-forming dresser 16, or the rotation CMP pad 12 can be halted during conditioning.

Various conditioning sequences are contemplated between the deglazing and asperity-forming dressers, and any such sequence is considered to be within the present scope. It can be beneficial, however, to form the asperities in the working surface of the CMP pad after the working surface has been deglazed. Otherwise, the newly formed asperities can be removed or disrupted by the deglazing process. That is not to say, however, that the working surface must be entirely deglazed prior to asperity formation in all cases. In one aspect, for example, deglazing the working surface and forming asperities in the working surface occur simultaneously at distinct and separate locations on the working surface until substantially all of the working surface has been conditioned. One example of simultaneous dressing is shown in FIG. 1, where both dressers are contacting the CMP pad simultaneously. In such cases, it may be beneficial to arrange the asperity forming dresser to follow the path of the deglazing dresser, or at least to form asperities in portions of the CMP pad that have already been deglazed.

Figure 2:
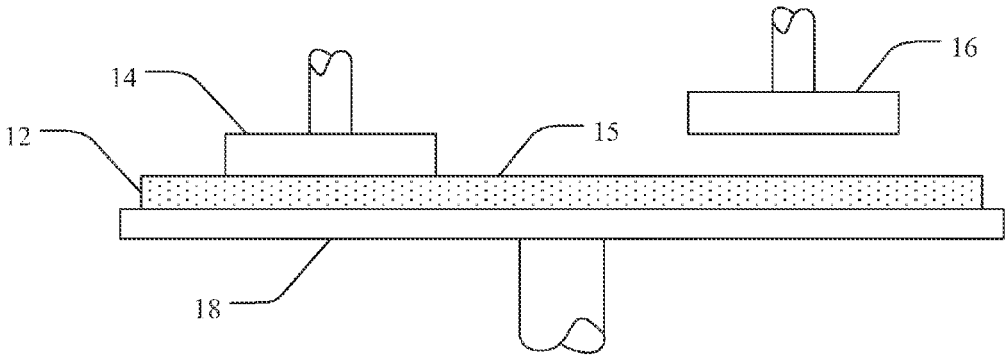
FIG. 2 is a schematic side view of a dressing system in accordance with an embodiment of the present invention.

In another aspect, the entire working surface of the CMP pad can be substantially completely deglazed prior to forming asperities. As is shown in FIG. 2, for example, the dressers 14, 16 do not contact the CMP pad 12 simultaneously. Thus the asperity-forming dresser 16 is precluded from contacting the pad until the deglazing dresser 14 has substantially completely or completely deglazed the entire working surface 15. Once the deglazing process is finished, the deglazing dresser is removed and the asperity-forming dresser is applied to the working surface to form asperities therein (not shown). It is noted that the numbering of FIG. 2 reflects the numbering of FIG. 1 for convenience, and thus those numbers not specifically described in FIG. 2 are referred back to FIG. 1. The same also applies to all subsequent figures.

Figure 3:
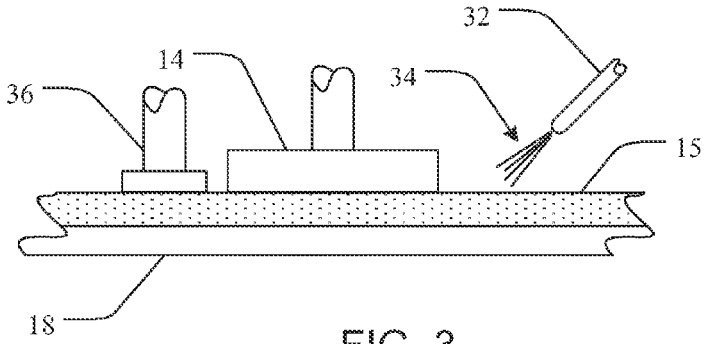
FIG. 3 is a schematic side view of a dressing system in accordance with an embodiment of the present invention.

In another aspect, a cleansing activity, such as a spray can be applied to the working surface at least prior to forming asperities, and in some cases, during deglazing. Various types of cleansing sprays can be utilized, including water, liquid chemicals, and the like. Additionally, a cleansing spray can be a spray of a gas. As is shown in FIG. 3, a liquid spray system 32 can be positioned relative to the working surface 15 of the CMP pad to apply or spray a cleansing liquid 34 thereupon. The cleansing liquid 34 can be positioned near the deglazing dresser 14 to manipulate and/or remove debris loosened during deglazing, as well as to lubricate the CMP pad to facilitate deglazing by the dresser. In one specific aspect, the cleansing liquid can be a water jet. The cleansing liquid can be applied at various positions relative to the dresser, including forward of the traveling path of the dresser, behind the traveling path of the dresser, or to the side of the traveling path of the dresser. Additionally, in some aspects the cleansing liquid can be applied to the CMP pad at a location within the deglazing dresser. For example, the cleansing liquid can be applied to the center of a dresser having an open access region within the dresser body. One non-limiting example of such a configuration can include a dresser shaped as a ring with an open center, wherein the cleansing liquid is applied through the open center. In another example, the cleansing liquid can be applied through one or more channels or ports that exit on the underside of the deglazing dresser. Thus, regardless of how or where the cleansing liquid is applied, in some aspects it can be beneficial for the cleansing liquid to flush debris from between the CMP pad and the dresser.

In another aspect, suction can be applied to the working surface to remove debris released from the CMP pad during deglazing. One example of such a suction device 36 is shown in FIG. 3. The suction device 36 can be positioned at any location relative to the deglazing dresser 14, including in front of, behind, to the side of, etc. In one aspect, however, it can be beneficial to locate the suction device behind the path of the dresser to allow an effective removal of loosened debris. In those aspects whereby a cleansing liquid is utilized along with a suction device, the suction device can also be located relative to the cleansing spray system. In one aspect, for example, it may be beneficial to locate the suction device to correspond with the debris loosened by the cleansing spray. In another aspect, an enclosure can be included around the deglazing dresser in order to contain the cleansing liquid at a discrete location relative to the dresser. In such a case, the cleansing liquid is utilized at the discrete location and removed by the suction device, thus facilitating improved deglazing via a localized action of the cleansing fluid and the suction.

In another aspect, a vibration can be applied between at least one of the dressers and the CMP pad during deglazing and/or asperity formation in order to improve the conditioning process. For example, a vibration system can be coupled to at least one of the deglazing dresser, the asperity-forming dresser, or the CMP pad (including the platen). In one specific aspect, the vibrating is ultrasonic vibrating.

As has been described, any deglazing dresser design capable of removing at least the glazed portion of the working surface of the CMP pad is considered to be within the present scope. In one aspect, for example, the deglazing dresser can include one or more blades or a plurality of blades positioned on the dresser to engage the CMP pad. As the dresser is moved relative to the CMP pad, the plurality of blades dig into the CMP pad surface and cut off the glazed portion, leaving a fresh, glaze-free surface for the formation of asperities. Various blade-type cutting elements are contemplated, and any such are considered to be within the present scope. In one specific aspect, the blades can be a polycrystalline diamond material. Further description regarding polycrystalline diamond blade materials can be found in U.S. patent application Ser. No. 12/267,172, filed on Nov. 7, 2008, which is incorporated herein by reference. In other aspects, the blades can be metal, diamond-coated metal, ceramic, polymeric, crystalline, and the like, including combinations thereof. In another aspect, larger superabrasive particles, such as diamond particles, can be used to deglaze the pad. Thus edges and/or faces of such larger superabrasive particles can be oriented in the deglazing dresser such that the superabrasive particles can effectively deglaze the pad. In some aspects, some or all of the diamond particles on the deglazing dresser may be irregular in shape and may present one or more sharp edges or apexes. Such particles may have tips leveled to the tolerances recited herein. It has been found that diamond particles, including irregularly shaped diamond particles, placed in specific patterns with sharp edges or apexes oriented toward the pad can provide a shaving effect sufficient to rapidly deglaze a CMP pad.

Additionally, any asperity-forming dresser design capable of forming asperities in the working surface of the CMP pad is considered to be within the present scope. In one aspect, for example, the asperity-forming dresser can include a plurality of superabrasive particles coupled to the asperity-forming dresser and positioned to engage the CMP pad. Thus, the plurality of superabrasive particles can dig into the deglazed surface as the dresser is moved relative to the CMP pad in order to form asperities in the working surface. One benefit of separating the deglazing and asperity-forming processes into separate dressers relates to superabrasive particle orientation. In many traditional CMP pad dressers, superabrasive particles performed both deglazing and asperity-forming tasks simultaneously. As such, the superabrasive particles were not selected and/or oriented in the dresser to maximize asperity formation, but rather, were oriented in arrangements that represented a tradeoff between the two tasks. The asperity-forming dressers of the present disclosure, however, can include superabrasive particles that are chosen and/or oriented in a manner that maximizes asperity formation. For example, in one aspect, blunt or dull diamond particles may be used and/or the diamond particles may be oriented in a manner that a face of the diamond particles is oriented toward the CMP pad. In some aspects, the diamond particles may also be arranged in a pattern upon the dresser which is specifically designed to maximize asperity creation on the CMP pad, or to form asperities having specifically desired properties, such as shape, size, distance from one another, and/or height, including uniform or substantially uniform height. It has been found that the use of blunt or dull diamond particles, or particles that otherwise present a face or dull edge toward the pad, have the effect of "piling" the pad along sides of the troughs or grooves being cut in the pad by the diamond particles. Such piling further adds to the creation of asperities, including achievement of the specific properties recited above, as well as other benefits.

Figure 4:
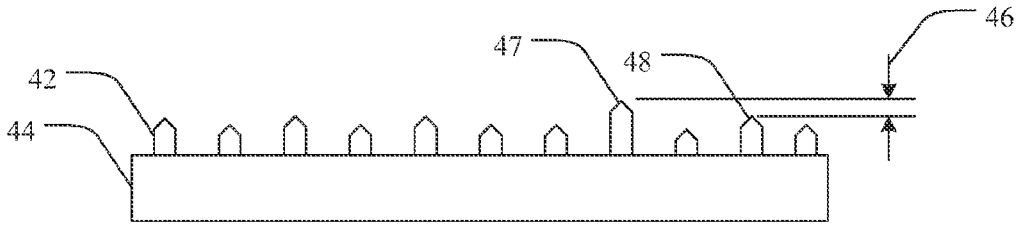
FIG. 4 is a schematic side view of a CMP pad dresser in accordance with an embodiment of the present invention.

As has been described, in some aspects it can be very beneficial to utilize a dresser having leveled superabrasive particle tips in order to form very uniform asperities in the CMP pad. In one aspect, for example, either a deglazing dresser or an asperity-forming dresser can include a plurality of superabrasive particles arranged in a monolayer, where the difference in protrusion distance between the highest protruding tip and the next highest protruding tip of the monolayer of superabrasive particles is less than or equal to about 20 microns and the difference in protrusion distance between the highest 1% of the protruding tips of the monolayer of superabrasive particles are within about 80 microns or less. In other words, for the 1% of the plurality of superabrasive particles that have the highest protruding tips, the variance in protrusion distance for that 1% is less than or equal to about 80 microns. As is shown in FIG. 4, one example of a dresser can include a monolayer of a plurality of superabrasive particles 42 embedded in a matrix layer 44, such that each superabrasive particle in the monolayer protrudes from the matrix layer. The difference in protrusion distance 46 between the highest protruding tip 47 and the next highest protruding tip 48 of the monolayer of superabrasive particles is less than or equal to about 20 microns.

Various methods can be utilized to measure superabrasive particle tip height to determine the difference in protrusion distance between tips. As such, any method for making such a determination is considered to be within the present scope. It should be noted that for the purposes of the present disclosure, the term "protrusion" refers to the height of a particle relative to some reference point. Techniques for such measurements can include direct measurements of the tip heights relative to a reference point such as, for example, the highest particle tip, a surface of a rigid support, the bottom surface of the matrix, etc. Measurements of particle height from the surface of the matrix material can be problematic, however, due to the irregular nature of such materials due to wicking around the superabrasive particles. In those cases whereby the matrix material is uniform, such a surface may be used to determine particle height. Additionally, a relative protrusion or height difference between two particles would be the difference in the heights between these particles measured from a common reference point. Additionally, in some cases the superabrasive particles may lie along a slope, curvature, or some other arrangement that is not parallel to the metal support layer. In these cases, the protrusion height would be normalized against the slope, curvature, or other arrangement so that the relative protrusion height difference between particles can be measured in the absence of the slope, curvature, etc. It should be noted that superabrasive particle tip height leveling can, in some cases, be independent from the positioning or patterning of the superabrasive particles across the surface of the dresser.

One example of a direct measurement technique can include an optical scanning process to evaluate superabrasive particle tip positions. In one such process, an optical scanner can scan the surface of the asperity-forming dresser to determine the height of the superabrasive particle tips relative to a fixed point. For example, the scanner can scan downward in space toward the dresser until the highest tip is located. The highest tip can then be set to the reference point, and the scanner can continue scanning in a direction toward the dresser measuring the distance from the reference point to each superabrasive particle tip across the surface of the dresser. Accordingly, the difference in protrusion distance between all of the superabrasive particles across the dresser can be directly measured.

Furthermore, measurement techniques can also include indirect measurements, such as, for example, applying the monolayer of superabrasive particles to a deformable substrate that deforms relative to the protrusion distance of the particle tips. The monolayer can be pressed into the deformable substrate and/or moved across the deformable substrate to form a scratch pattern therein. Tip height can thus be extrapolated from such indirect measurements.

A variety of materials are contemplated for use as superabrasive particles. Any superabrasive known that can be utilized in a CMP pad dresser should be considered to be within the present scope. Non-limiting examples of such materials include diamond materials, nitride materials, ceramics, and the like. In one aspect, the superabrasive particles include diamond materials. Such diamond materials can include natural or synthetic diamond, single crystal, polycrystalline, and the like. In another aspect, the superabrasive particles include cubic boron nitride materials. Additionally, various diamond particles sizes can be used, including mesh sizes such as 10/20, 30/40, 80/90, 90/100, 100/120, 120/140, 140/170, 170/200, 200/230, 230/270, 270/325, and 325/400.

A CMP pad dresser having such substantially leveled tip arrangements can have a low scratch rate because superabrasive particles are less likely to pull out of the matrix layer due to their more uniform protrusion distribution compared to traditional dressers. Additionally, the more uniform protrusion distributions of such a dressers allows the conditioning of CMP pads in such a manner as to facilitate good polishing rates while at the same time extending the effective working life of the dresser. These benefits can be affected by, for example, uniform asperity spacing and size distribution in the CMP pad.

In one aspect, the superabrasive particles can be arranged into a predetermined pattern. Such a pattern can be a uniformly distributed pattern or a non-uniformly distributed pattern. Additionally, a variety of techniques are contemplated to facilitate the arrangement of superabrasive particles into a predetermined pattern. Predetermined is understood to mean a non-random pattern that has been determined prior to arranging the superabrasive particles. In one aspect, a predetermined pattern can also apply to a predetermined spacing between particles. Non-limiting examples of such techniques include arrangement by a template, arrangement using spots of adhesives, arrangement on a first substrate followed by a pattern specific transfer from the first substrate to a metal support layer, and the like, including combinations thereof. The superabrasive particles can be temporarily held in position in the predetermined pattern using a variety of techniques, including, without limitation, adhesives, dimpled locations on the metal support matrix, a supporting compound such as, for example, a wax, and the like, including combinations thereof. In one specific aspect, the superabrasive particles can be temporarily coupled to the metal support layer using an adhesive that then volatilizes away and is eliminated during construction of the dresser.

The superabrasive particles and/or cutting blades can be coupled to a dresser using a bonding material. The bonding material can be any material capable of securing superabrasive particles therein. Non-limiting examples of bonding materials include metal brazes, metal braze alloys, organic matrix materials, sintered materials, electroplated materials, and the like, including combinations thereof. It should be noted that, while superabrasive particles are discussed for convenience, the present discussion and techniques also applies to any cutting elements, including cutting blades. In some aspects, blades used in the present invention can have a straight, substantially uniform cutting edge, and in other aspects, the cutting edge may be serrated or have teeth or other protrusions (i.e. asperities). Such asperities may have a specific pattern or design implemented in order to achieve a specific dressing result.

In one aspect, the superabrasive particles can be brazed to a metal support layer, and thus the bonding material can be a metal braze or metal braze alloy. Metal brazing techniques are known in the art. A green braze material can be applied to the metal support layer on or around the superabrasive particles. The metal braze can be applied in any know configuration, including braze sheets, powders, pastes, sprays, and the like, including combinations thereof. Once applied to the metal support layer, the braze can be heated and melted to coat at least a portion of the metal support layer and to bond the superabrasive particles. The heating temperature can vary depending on the braze material used, but in one aspect can be from about 700° C. to about 1200° C. The superabrasive particles in the first and second monolayer are thus arranged such that thermal forces exerted on the metal support layer during heating and cooling are substantially equalize in order to minimize warping.

In one non-limiting example, the superabrasive particles can be bonded to the metal support layer by brazing with a nickel-based alloy containing chromium. In another example, the brazing can include pressing the superabrasive particles with a flat ceramic material that cannot be bonded to the braze in order to level the superabrasive particle tips. Various braze alloys are contemplated, including non-limiting examples such as $BNi_2$, $BNi_7$, and the like.

Additionally, in one aspect the superabrasive particles can be coupled to a metal support layer by an electrodeposition process, and thus the bonding material can be an electrodeposited metal material. As an example of a suitable method for positioning and retaining abrasive materials prior to and during the electrodeposition process, a mold can be used that includes an insulating material that can effectively prevent the accumulation of electrodeposited material on the molding surface. Superabrasive particles can be held on the molding surface of the mold during electrodeposition. As such, the accumulation of electrodeposited material can be prevented from occurring on the particle tips and the working surface of the pad conditioner substrate. Such techniques are described in U.S. patent application Ser. No. 11/292,938, filed Dec. 2, 2005, which is hereby incorporated herein by reference.

In another aspect, the superabrasive particles can be bonded to the metal support layer by sintering, and thus the bonding material can include a sintering material. For example, the bonding of the superabrasive particles to the metal support layer can include disposing a sintering compound on the metal support layer in contact with the superabrasive particles and sintering the sintering compound to bond the superabrasive particles to the metal support layer. Suitable sintering methods will be readily appreciated by one of ordinary skill in the art having possession of this disclosure. Basically, a sintering compound is applied around the superabrasive particles and in contact with the metal support layer. The sintering compound can be any known sintering material that can be used to secure superabrasive particles to a substrate. Non-limiting examples of such materials can include metal and metal alloy powders, ceramic powders, and the like. One specific non-limiting example of a sintering compound is cobalt powder.

Once the sintering compound has been applied around the superabrasive particles and to the metal support substrate, heat and in some cases pressure can be applied to cause sintering to occur. In some aspects, a braze or braze alloy can be infiltrated into the sintering compound during bonding to further strengthen the bonding material matrix.

In another aspect, a CMP pad dresser can be comprised of a plurality of dressing segments having a plurality of leveled superabrasive particles tips, where the plurality of dressing segments are held in place by a rigid support. Such a design allows a plurality of smaller dressing segments to be manufactured having precisely leveled tips. Smaller diameter metal support layers in these dressing segments can be made by processes involving heat and/or pressure with less warpage due to their smaller size. For example, a 4 inch diameter metal disc can exhibit greater warping due to brazing as compared to a 0.5 inch diameter metal disc. Thus thermal distortion and particle floating problems are decreased. A plurality of such dressing segments can then be coupled to a larger diameter rigid support by processes that do not introduce significant warpage, such as bonding in an organic material. Such dressing segments can have one or more layer(s) of superabrasive particles coupled to a support layer. In one aspect, a segment can have a single layer of superabrasive particles coupled to a metal support layer. Thus, this process allows the manufacture of CMP pad dressers that can have precise tip protrusion tolerances. Additionally, in one aspect, each dressing segment can have at least three superabrasive particles that protrude to the greatest extent. If the three highest protruding superabrasive particles on every dressing segment are leveled across the entire rigid support, a CMP pad dresser is made having very precise tip leveling across the entire surface. If, for example, ten dressing segments are used to make the CMP pad dresser, then the highest protruding thirty superabrasive particles in the tool will have effectively the same protrusion distance and be substantially leveled. Various additional details regarding dressing segments are detailed in U.S. patent application Ser. No. 13/034,213, filed Feb. 24, 2011, which is hereby incorporated herein by reference. Dressing segments containing at least one cutting blade are also contemplated.

Various organic materials are contemplated for use as a rigid support and/or to be used to secure the second monolayer of superabrasive particles and/or the dressing segments to the rigid support. Examples of suitable organic matrix materials include, without limitation, amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof. In one specific aspect, the organic material can be an epoxy resin. In another aspect, the organic material can be a polyimide resin. In yet another aspect, the organic material can be a polyurethane resin.

Additionally, so-called "reverse casting" methods can be used to accurately orient and attach the dressing segments to the rigid support. Such methods can include initially securing the plurality of dressing segments to a substrate using a "mask" material. The portions of the dressing segments protruding from the mask material can then be attached to the rigid support using the methods discussed herein, after which (or during which), the masking material can be removed.

When an organic material is utilized, methods of curing the organic material can be a variety of processes known to one skilled in the art that cause a phase transition in the organic material from at least a pliable state to at least a rigid state. Curing can occur, without limitation, by exposing the organic material to energy in the form of heat, electromagnetic radiation, such as ultraviolet, infrared, and microwave radiation, particle bombardment, such as an electron beam, organic catalysts, inorganic catalysts, or any other curing method known to one skilled in the art.

In one aspect of the present invention, the organic material can be a thermoplastic material. Thermoplastic materials can be reversibly hardened and softened by cooling and heating respectively. In another aspect, the organic material layer may be a thermosetting material. Thermosetting materials cannot be reversibly hardened and softened as with the thermoplastic materials. In other words, once curing has occurred, the process can be essentially irreversible, if desired.

As a more detailed list of what is described above, organic materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; polyamide resins; polyimide resins; reactive urethane resins; polyurethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite™ trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the organic material may be an epoxy resin. In another aspect, the organic material may be a polyimide resin. In yet another aspect, the organic material may be a polyurethane resin.

Numerous additives may be included in the organic material to facilitate its use. For example, additional crosslinking agents and fillers may be used to improve the cured characteristics of the organic material layer. Additionally, solvents may be utilized to alter the characteristics of the organic material in the uncured state. Also, a reinforcing material may be disposed within at least a portion of the solidified organic material layer. Such reinforcing material may function to increase the strength of the organic material layer, and thus further improve the retention of the individual abrasive segments. In one aspect, the reinforcing material may include ceramics, metals, or combinations thereof. Examples of ceramics include alumina, aluminum carbide, silica, silicon carbide, zirconia, zirconium carbide, and mixtures thereof.

Additionally, in one aspect a coupling agent or an organometallic compound may be coated onto the surface of a superabrasive material to facilitate the retention of the superabrasive particles in the organic material via chemical bonding. A wide variety of organic and organometallic compounds is known to those of ordinary skill in the art and may be used. Organometallic coupling agents can form chemicals bonds between the superabrasive materials and the organic material, thus increasing the retention of the superabrasive materials therein. In this way, the organometallic coupling agent can serve as a bridge to form bonds between the organic material and the surface of the superabrasive material. In one aspect of the present invention, the organometallic coupling agent can be a titanate, zirconate, silane, or mixture thereof. The amount of organometallic coupling agent used can depend upon the coupling agent and on the surface area of the superabrasive material. Oftentimes, 0.05% to 10% by weight of the organic material layer can be sufficient.

Specific non-limiting examples of silanes suitable for use in the present invention include: 3-glycidoxypropyltrimethoxy silane (available from Dow Corning as Z-6040); γ-methacryloxy propyltrimethoxy silane (available from Union Carbide Chemicals Company as A-174); β-(3,4-epoxycyclohexyl)ethyltrimethoxy silane, γ-aminopropyltriethoxy silane, N-(β-aminoethyl)-γ-aminopropylmethyldimethoxy silane (available from Union Carbide, Shin-etsu Kagaku Kogyo K. K., etc.). Specific non-limiting examples of titanate coupling agents include: isopropyltriisostearoyl titanate, di(cumylphenylate)oxyacetate titanate, 4-aminobenzenesulfonyldodecylbenzenesulfonyl titanate, tetraoctylbis(ditridecylphosphite) titanate, isopropyltri(N-ethylamino-ethylamino) titanate (available from Kenrich Petrochemicals. Inc.), neoalkyoxy titanates such as LICA-01, LICA-09, LICA-28, LICA-44 and LICA-97 (also available from Kenrich), and the like. Specific non-limiting examples of aluminum coupling agents include acetoalkoxy aluminum diisopropylate (available from Ajinomoto K. K.), and the like. Specific non-limiting examples of zirconate coupling agents include: neoalkoxy zirconates, LZ-01, LZ-09, LZ-12, LZ-38, LZ-44, LZ-97 (all available from Kenrich Petrochemicals, Inc.), and the like. Other known organometallic coupling agents, e.g., thiolate based compounds, can be used in the present invention and are considered within the scope of the present invention.

In other aspects of the present disclosure, superabrasive particle tips can be leveled by reducing the protrusions of particles that are outside of the desired tolerance range. Once such particles are identified, various techniques can be utilized to reduce such protrusions. In one aspect, for example, mechanical abrasion of the dresser can reduce the protruding particles. In another aspect, a vibration tool can be used to individually break such particles. In yet another aspect, a laser such as a Nd:YAG laser can be used to disrupt such particles.

Example

A deglazing dresser is made as follows: Polycrystalline diamond (PCD) blades are formed and mounted in epoxy by a process of reverse casting. The blades are made of coarse grain micron diamond (e.g. 25 microns). The blades are sliced from a PCD blank made by high pressure sintering of micron diamond. 12 blades are mounted at an angle with respect to the dresser to expose sharp edges with serrated diamond grains. Since the diamond grains of the PCD blades are sintered at ultrahigh pressure, these grains are held by diamond-to-diamond bonds, so there is little risk of portions of the PCD blades falling out during abrading against a soft pad polyurethane CMP pad.

During a conditioning procedure, the blades are leveled and rotated against a CMP pad that is also rotating. A water jet is used to spray water in the front of the disk that is advancing on pad. The disk is surrounded by a hollow channel that is connected to a pump to suck the water out. The pad is shaved by the rotating the PCD blades and the dirt, including material glazed on the surface (debris, abrasives, shredded pad material) are sucked away. The pad is thus relatively cleaned by the deglazing process.

The cleaned surface of the CMP pad is then dressed using an asperity-forming dresser having superabrasive particle coupled thereto. The tips of the superabrasive particles are leveled, and thus create substantially uniform asperities in the CMP pad surface.

A slurry having abrasives suspended therein is then applied to the surface of the pad, and a wafer is pressed against the cleaned pad asperities for CMP processing.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of dressing a CMP pad, comprising:

applying a deglazing dresser to a working surface of a CMP pad;

deglazing the working surface of the CMP pad with the deglazing dresser;

applying an asperity-forming dresser to the working surface of the CMP pad; and forming asperities in the working surface of the CMP pad with the asperity-forming dresser with a plurality of superabrasive particles coupled to the asperity-forming dresser; and wherein the superabrasive particles are arranged in a monolayer of superabrasive particles with a difference in protrusion distance between the highest protruding particle tip and the next highest protruding particle tip of the monolayer of superabrasive particles is less than or equal to about 20 microns and the difference in protrusion distance between the highest 1% of the protruding particle tips of the monolayer of superabrasive particles are within about 80 microns or less.

2. The method of claim 1, wherein the working surface of the CMP pad is substantially completely deglazed prior to forming the asperities.

3. The method of claim 1, wherein substantially the entire working surface of the CMP pad is substantially completely deglazed prior to forming the asperities.

4. The method of claim 1, wherein deglazing the working surface and forming asperities in the working surface occur simultaneously at distinct and separate locations on the working surface until substantially all of the working surface has been conditioned.

5. The method of claim 1, wherein deglazing the working surface of the CMP pad includes shaving off a thickness of the working surface of the CMP pad.

6. The method of claim 5, wherein shaving off the thickness of the working surface of the CMP pad includes shaving off the thickness with a plurality of blade elements coupled to the deglazing dresser.

7. The method of claim 1, further comprising applying a cleansing spray to the working surface during deglazing.

8. The method of claim 7, wherein the cleansing spray is a water jet.

9. The method of claim 7, further comprising applying a suction to the working surface to remove debris released from the CMP pad during deglazing.

10. The method of claim 1, further comprising vibrating at least one of the deglazing dresser and the CMP pad relative to one another during deglazing or the asperity-forming dresser and the CMP pad relative to one another during formation of the asperities.

11. The method of claim 10, wherein the vibrating is ultrasonic vibrating.

12. A system for dressing a CMP pad, comprising:

a deglazing dresser positioned to engage a CMP pad; and an asperity-forming dresser positioned to engage the CMP pad, said dresser having plurality of superabrasive particles positioned to form asperities in a working surface of the CMP pad, said superabrasive particles being arranged in a monolayer of superabrasive particles with a difference in protrusion distance between the highest protruding particle tip and the next highest protruding particle tip of the monolayer of superabrasive particles of less than or equal to about 20 microns and the difference in protrusion distance between the highest 1% of the protruding particle tips of the monolayer of superabrasive particles are within about 80 microns or less;

wherein the deglazing dresser and the asperity-forming dresser are each capable of independently dressing the CMP pad.

13. The system of claim 12, further comprising a platen for holding and rotating the CMP pad, the platen being positioned to engage the deglazing dresser and the asperity-forming dresser.

14. The system of claim 12, further comprising a liquid spray system positioned to spray a cleansing liquid onto the CMP pad to remove debris during deglazing.

15. The system of claim 12, further comprising a vibration device associated with at least one of the deglazing dresser, the asperity-forming dresser, or the CMP pad.

16. The system of claim 12, wherein the deglazing dresser includes a plurality of blade elements positioned to shave off a thickness of the working surface of the CMP pad.

* * * * *